US006453506B1

(12) United States Patent
Sumner

(10) Patent No.: US 6,453,506 B1
(45) Date of Patent: Sep. 24, 2002

(54) CARPET STEAM CLEANING APPARATUS WITH CONTROL FOR DIRECTING SPRAY AT FRONT OR BACK OF WAND VACUUM HEAD

(76) Inventor: Gary Sumner, 3103 Sunflower Dr., Antioch, CA (US) 94509

( * ) Notice: Subject to any disclaimer, the term of this patent is extended or adjusted under 35 U.S.C. 154(b) by 0 days.

(21) Appl. No.: 09/795,786

(22) Filed: Feb. 27, 2001

(51) Int. Cl.[7] ..... A47L 9/32
(52) U.S. Cl. ..... 15/322; 15/321
(58) Field of Search ..... 15/322, 321

(56) References Cited

U.S. PATENT DOCUMENTS

| | | | | | |
|---|---|---|---|---|---|
| 787,388 | A | * | 4/1905 | Moorhead | 15/345 |
| 4,139,922 | A | | 2/1979 | Fitch | 15/321 |
| 4,167,799 | A | | 9/1979 | Webb | 15/320 |
| 4,168,562 | A | * | 9/1979 | Maasberg | 15/320 |
| 4,472,855 | A | * | 9/1984 | Murphy et al. | 15/321 |
| 4,951,346 | A | * | 8/1990 | Salmon | 15/321 |
| 4,956,891 | A | * | 9/1990 | Wulff | 15/320 |
| 5,347,678 | A | | 9/1994 | Williams et al. | 15/331 |
| 6,263,539 | B1 | * | 7/2001 | Baig | 15/321 |

* cited by examiner

*Primary Examiner*—Theresa T. Snider
(74) *Attorney, Agent, or Firm*—Thomas R. Lampe

(57) ABSTRACT

Carpet cleaning apparatus includes a cleaning wand having a vacuum head and an elongated member forming a passageway for transporting material removed from a carpet by the vacuum head. A cleaning liquid spray nozzle is located at the front of the vacuum head and another cleaning liquid spray nozzle is located at the back of the vacuum head. Two control valves are attached to the elongated member, each controlled by a separate moveable handle, allowing the operator to selectively spray in front or in back of the vacuum head as desired.

11 Claims, 5 Drawing Sheets

CARPET STEAM CLEANING APPARATUS WITH CONTROL FOR DIRECTING SPRAY AT FRONT OR BACK OF WAND VACUUM HEAD

TECHNICAL FIELD

This invention relates to apparatus utilized to clean carpets.

BACKGROUND OF THE INVENTION

It is well known to utilize portable steam cleaning equipment to clean carpets. These devices work on the same principle; they spray hot water on the carpet and the water is removed from the carpeting as quickly as possible. Rather than just employ hot water as the liquid cleaner, detergents and the like can be combined therewith to increase effectiveness of the operation.

The earlier steamers employed wands called drag wands which were manually manipulated by an operator and applied the liquid cleaner to the carpet. Immediately thereafter the liquid cleaner was removed by a vacuum applied through the wand. The drag wand only works on a backward stroke due to the fact that the water or other liquid cleaner is sprayed on the carpet operator would adjust the length of the handle on the drag wand to the height of his waist, both hands being positioned side-by-side and a few inches apart on the grip of the handle.

Spots on a carpet may need to be gone over more than once while steam cleaning. With the drag wand, the operator would have to stop the flow of water by letting go of the handle with his right hand and lift the lever to the off position. He would then drag the wand to pick up the excess water on the carpet. The wand would then be rolled forward over the spot. In this latter step there is no cleaning action taking place. After turning the water back on, the operator grips the handle as he goes over the spot again on the back stroke. Sometimes this would have to be repeated several times to get the spot out, a very time consuming process to say the least. Drag wands are quite heavy and very slow. Use and transfer exert a toll on the operator's stamina. Cleaning area rugs with a drag wand requires two people, one to stand on the end of the rug so the rug would not move with the wand, and the other to work the drag wand.

A more recent development in the field of steam cleaning wands is the scrub wand characterized by its relatively light weight and ease of handling. The scrub wand is designed to have one hand placed at the top portion of the wand with that hand controlling the valve for the water spray. The other hand is positioned on the grip handle. This wand works by moving the wand back and forth in a scrubbing motion, hence the name scrub wand. As with the drag wand, a spray nozzle is located on only one side of the vacuum head, behind the vacuum slit of the wand vacuum head. The scrub wand works on the same principle as the drag wand and when the operator pushes the scrub wand forward with the water on all that is accomplished is wetting of the carpet, due to the fact that the vacuum slit is in front of the water spray. A separate rearward movement of the wand must be made to vacuum extract the water from the carpet.

All carpet has a grain and on some carpets the grain can make the wand bounce on the backward or forward stroke, losing the vacuum seal on the carpet and thus reducing the effectiveness of the extraction process. The operator would have to use another or extra forward or backward stroke to extract the water that was left behind, further slowing down the operator. Another drawback of the scrub wand is that when cleaning area rugs it normally requires two operators, one to hold down the rug while it is being cleaned and the other operator to maneuver the wand.

As will be seen below, the drawbacks of the drag and scrub wands are eliminated with the apparatus of this invention. The apparatus allows the operator to place a water spray in front of as well as in back of the vacuum slit of the wand vacuum head. These water sprays are independently controlled by valves located at two handles of the wand and operated by manipulation of the handles.

A search directed to this invention located the following patents: U.S. Pat. No. 4,167,799, issued Sep. 18, 1979, U.S. Pat. No. 5,347,678, issued Sep. 20, 1994, and U.S. Pat. No. 4,139,922, issued Feb. 20, 1979.

Two of the patents, U.S. Pat. Nos. 4,167,799 and 4,139,922, show the general idea of employing a plurality of spray nozzles in carpet cleaning machines. These devices are, however, relatively specialized, complicated and heavy pieces of equipment, with the arrangements disclosed not lending themselves to use with a manually held and operated wand.

DISCLOSURE OF INVENTION

The present invention relates to carpet cleaning apparatus of the hand-held and manipulated wand type which effectively and efficiently provides for the cleaning of carpets. The term carpets as employed herein also encompasses rugs and other types of floor coverings. The invention is characterized by its relative simplicity and ease of use.

The carpet cleaning apparatus of the invention incorporates a cleaning wand including a vacuum head having a vacuum head front and a vacuum head rear for applying a vacuum to a carpet. The vacuum head defines a vacuum head interior and a vacuum head inlet communicating with the vacuum head interior.

The cleaning wand also includes an elongated member connected to the vacuum head and defining a passageway in communication with the vacuum head interior for applying a vacuum to the vacuum head interior and transporting material removed from a carpet by the vacuum head.

A first manually graspable handle is connected to the elongated member at a first location on the elongated member.

A second manually graspable handle is connected to the elongated member at a second location on the elongated member.

A front spray nozzle is located adjacent to the vacuum head at the vacuum end front and in front of the vacuum head inlet.

A rear spray nozzle is located adjacent to the vacuum head at the vacuum head rear and to the rear of the vacuum head inlet.

Valve means is operatively associated with the first and second manually graspable handles for selectively controlling the flow of liquid cleaner to the front and rear spray nozzles from a source of liquid cleaner.

Other features, advantages and objects of the present invention will become apparent with reference to the following description and accompanying drawings.

MODES FOR CARRYING OUT THE INVENTION

Figures 1, 2:
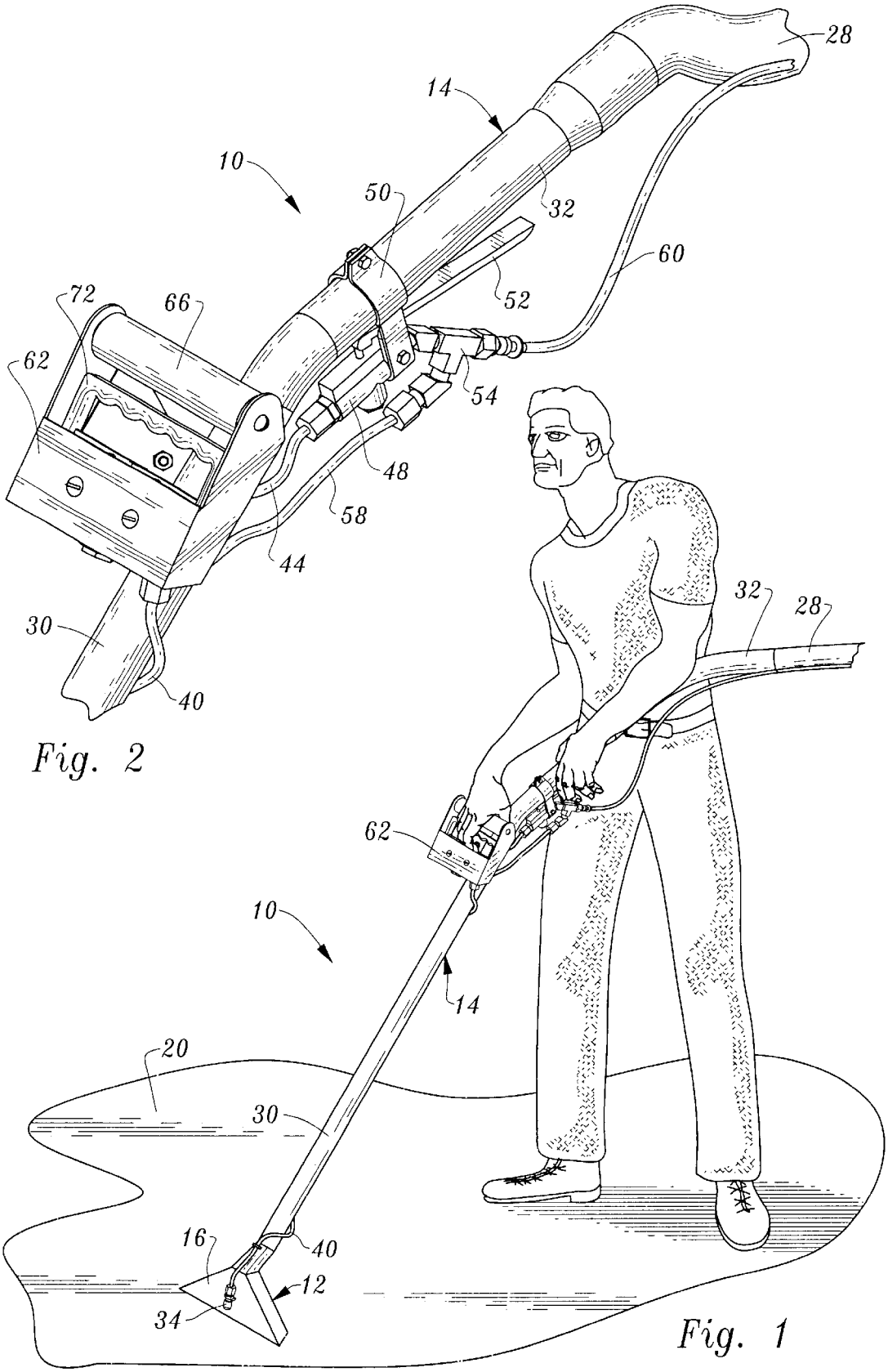
FIG. 1 is a perspective view of an individual cleaning a carpet with apparatus constructed in accordance with the teachings of the present invention.
FIG. 2 is a perspective view of a selected portion of the apparatus, including structure relating to the handles employed therein.
Figure 3:
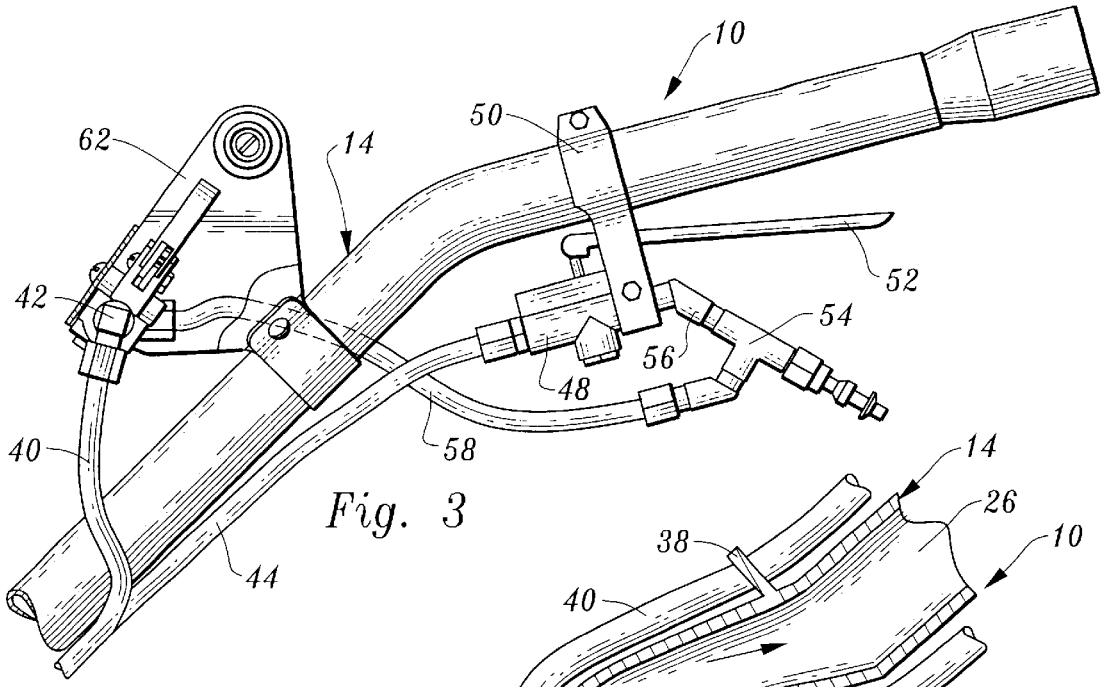
FIG. 3 is a side elevational view of the portion of the invention generally corresponding to that shown in FIG. 2.

Referring now to FIGS. 1–8, carpet cleaning apparatus constructed in accordance with the teachings of the present invention includes a cleaning wand 10 incorporating a vacuum head 12 and an elongated member 14.

Vacuum head 12 has a vacuum head front 16 and a vacuum head rear 18. As is conventional, the vacuum head is for applying a vacuum to a carpet, such as carpet 20, and defines a vacuum head interior 22 and a vacuum head inlet 24 communicating with the vacuum head interior.

Elongated member 14 is attached to the vacuum head and defines a passageway 26 in communication with the vacuum head interior for applying a vacuum to the vacuum head interior and transporting material removed from the carpet by the vacuum head. A hose 28 leads from passageway 26 to a suitable vacuum source, such as a tank, not shown. Elongated member 14 includes a primary elongated member segment 30 and a secondary elongated member segment 32. The elongated member segments are angularly disposed relative to one another and the primary elongated member segment is longer than the secondary elongated member segment.

A front spray nozzle 34 is located adjacent to the vacuum head at the vacuum head front 16. Nozzle 34 is in front of the vacuum head inlet 24. Rear spray nozzle 36 is located adjacent to the vacuum head at the vacuum head rear 18 and is positioned to the rear of the vacuum head inlet.

Front spray nozzle 34 is attached to the vacuum head by a bracket 38 accommodating conduit 40. A coupling secures the top end of conduit 40 to the exit of a fluid flow control valve 42. The nozzle 34 is attached to the lower end of conduit 40 by a coupling.

Rear spray nozzle 36 is attached by a coupling to conduit 44, the nozzle 36 being secured to a bracket 46 projecting from the vacuum head. The conduit 44 extends along elongated member 14 and is connected by a coupling to the outlet of a fluid flow control valve 48. Fluid flow control valve 48 is secured to the underside of elongated member 14, more specifically to secondary elongated member segment 32, by a bracket 50.

Figure 4A:
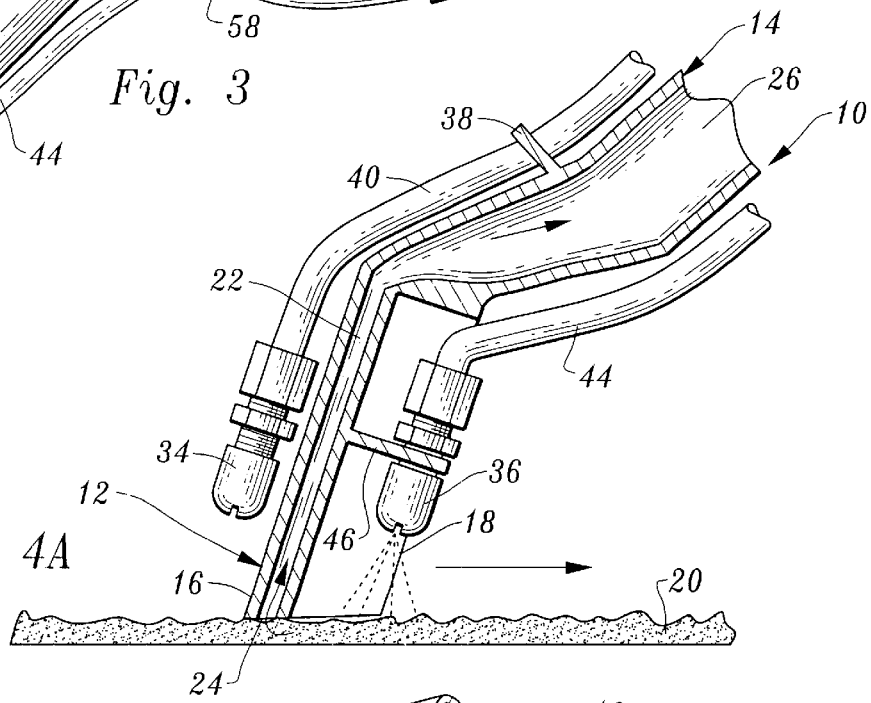
FIG. 4A is a greatly enlarged cross-sectional view illustrating a portion of the apparatus incorporating the vacuum head and spray nozzles when cleaning the carpet, spray exiting the rear spray nozzle.
Figure 4B:
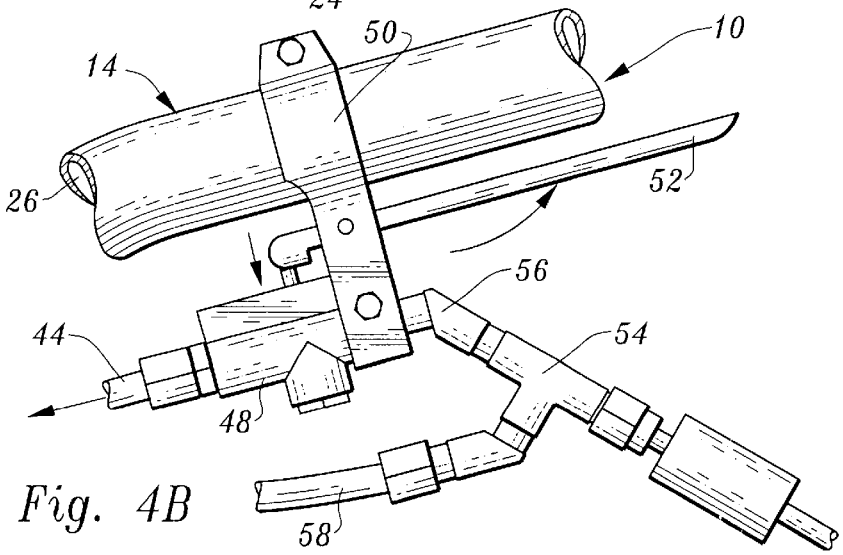
FIG. 4B is a side elevational view showing the cooperative relationship between one of the handles and an associated control valve to effect the spray shown in FIG. 4A.

A handle or trigger 52 is pivotally attached to the bracket 50, the handle 52 being used to open valve 48 when pivoted by the operator's hand. One end of the handle 52 engages a spring biased actuator of valve 48, the valve normally being closed. When the handle 52 is moved as shown in FIG. 4B, the spring biased actuator of the valve is depressed as indicated by the arrows and the valve is opened.

The inlet of the fluid flow control valve 48 is connected to a tee connector 54 by a branch conduit 56. Another leg of the tee 54 is connected to another branch conduit 58. Branch conduit 58 leads to the inlet of fluid flow control valve 42. The inlet of tee 54 is attached by a suitable coupling to a primary conduit 60 which leads to a source of water or other liquid cleaner. This may be, for example, a tank holding hot or cold water which is pumped and pressurized. From the above description, it may be seen that the liquid from primary conduit 60 is divided into two streams fed to the inlets of control valves 42, 48.

Attached to primary elongated member segment 30 and disposed above the top of the elongated member is a housing or saddle 62. Housing 62 is concave at the bottom thereof to conform to the shape of the elongated member and a bracket 64 and threaded fasteners are employed to hold the housing securely in place.

Housing 62 defines an opening which accommodates a fixed handle portion 66. The handle portion 66 is secured in place by bolts 68 passing through the sides of the housing, the ends of the fixed handle portion 66 and threadedly secured to an elongated threaded nut 70 within the interior of the handle portion.

Figure 5:
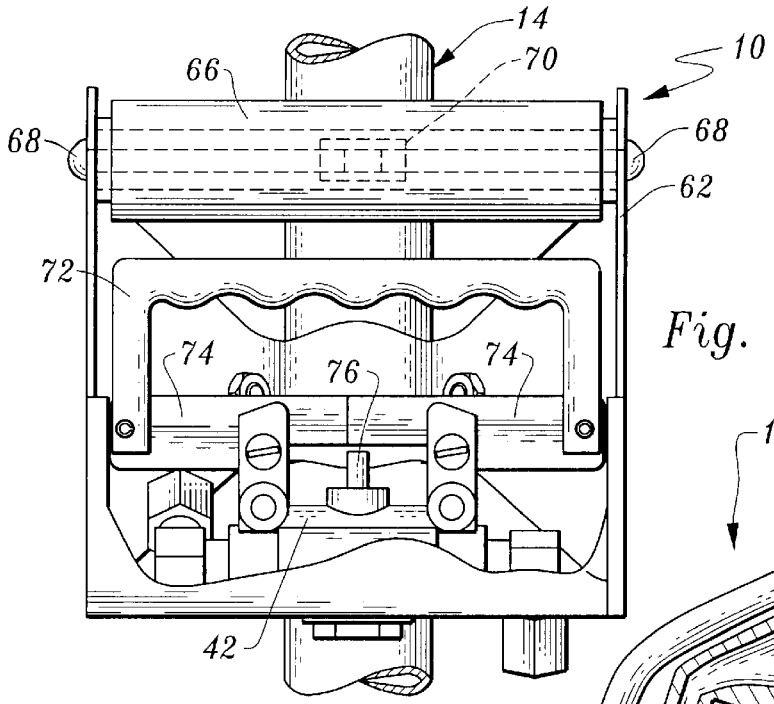
FIG. 5 is an enlarged view, partially broken away, illustrating operational details of the other handle and valve employed in the apparatus along with associated structure including a mechanical linkage interconnecting the handle and valve and a housing or saddle employed therewith.

The interior of housing 62 includes a recess accommodating a slidable handle or trigger portion 72 which is normally in the position shown in FIG. 5. Handle portions 66, 72 are close enough to allow an operator to wrap his or her hand thereabout, as shown in FIG. 1, for example; they are also far enough away to allow an operator to wrap his or her hand around portion 66 without touching portion 72.

Pivotally connected to housing 62 are two link arms 74 of a mechanical linkage. These link arms 74 are pivotally attached at the outer ends thereof to slidable handle portion 72. The inner ends of the link arms are disposed over the actuator of fluid flow control valve 42, such actuator normally being in the extended position and maintained thereby by a spring within the control valve. FIG. 5 shows the normal at rest positions of the link arms and the control valve actuator (designated by reference numeral 76) in the absence of upward pressure being exerted on slidable handle or trigger portion 72.

Figure 6A:
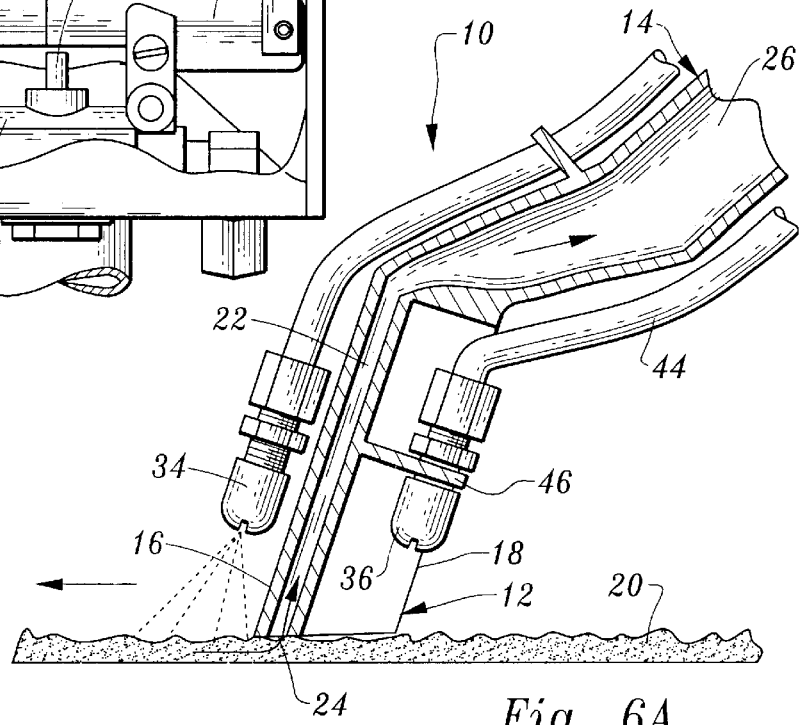
FIG. 6A is a view similar to FIG. 4A, but showing spray exiting the front spray nozzle rather than the rear spray nozzle.
Figure 6B:
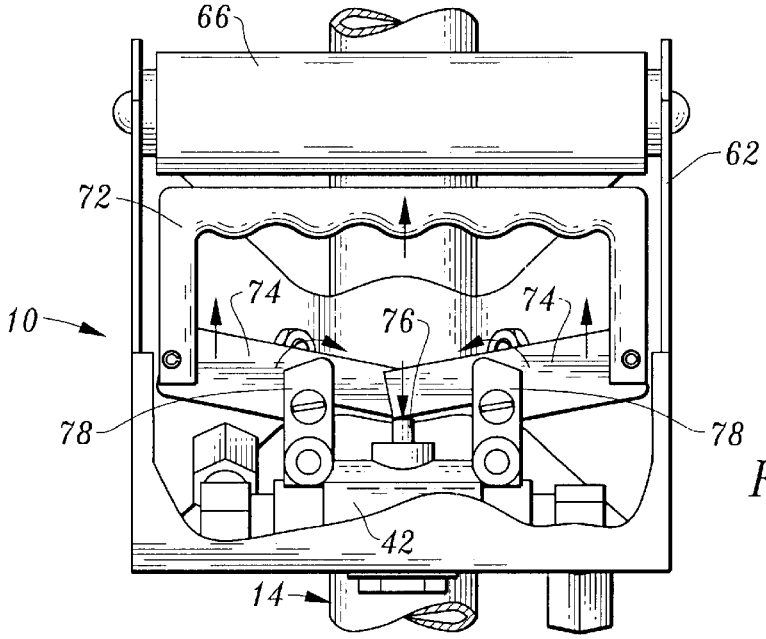
FIG. 6B is similar to FIG. 5 but illustrating the relative positions assumed by structural components of the apparatus to effect spray from the front spray nozzle as shown in FIG. 6A.
Figure 7:
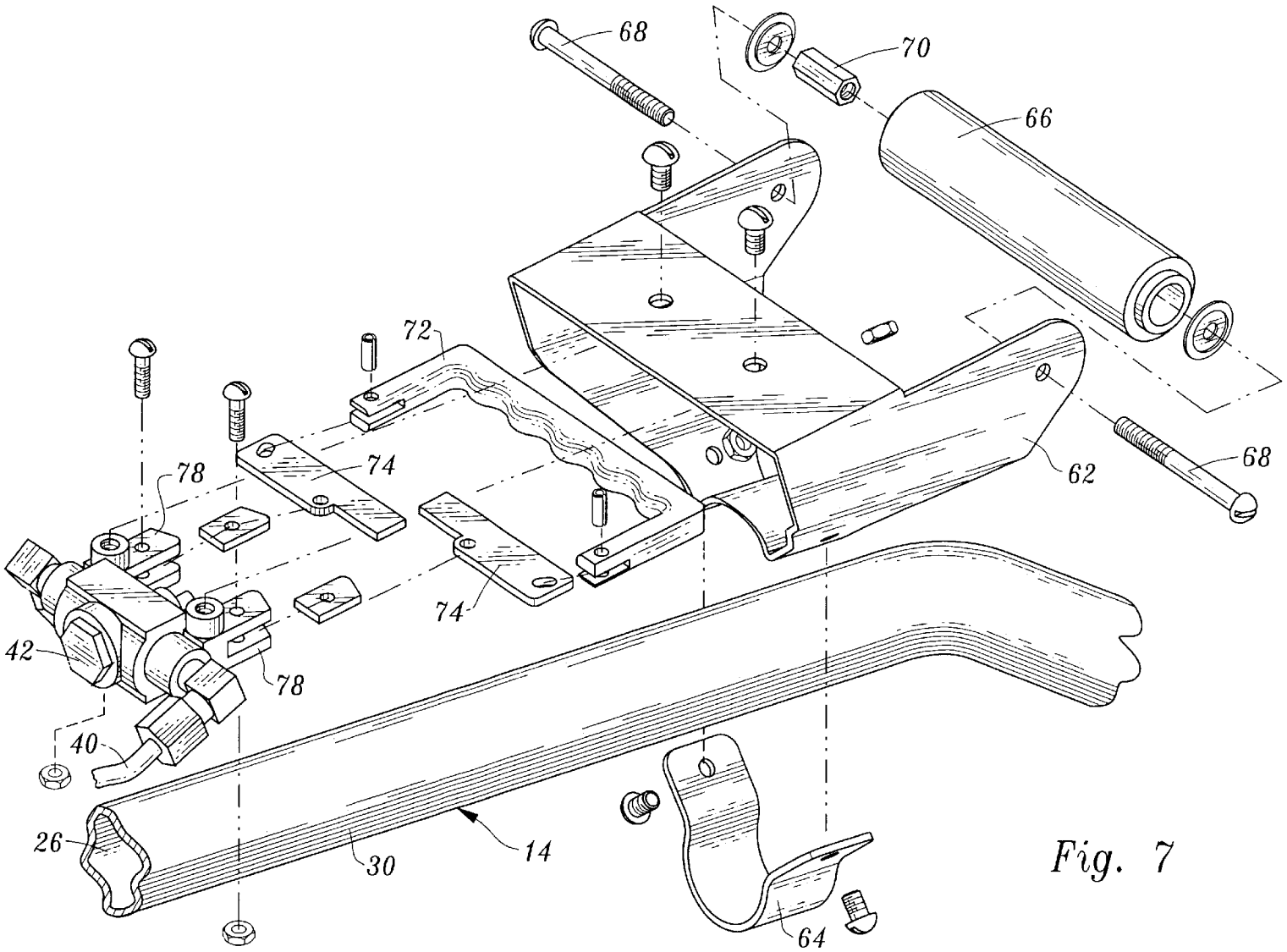
FIG. 7 is an exploded, perspective view of the handle and related structure as shown in FIGS. 5 and 6B.
Figure 8:
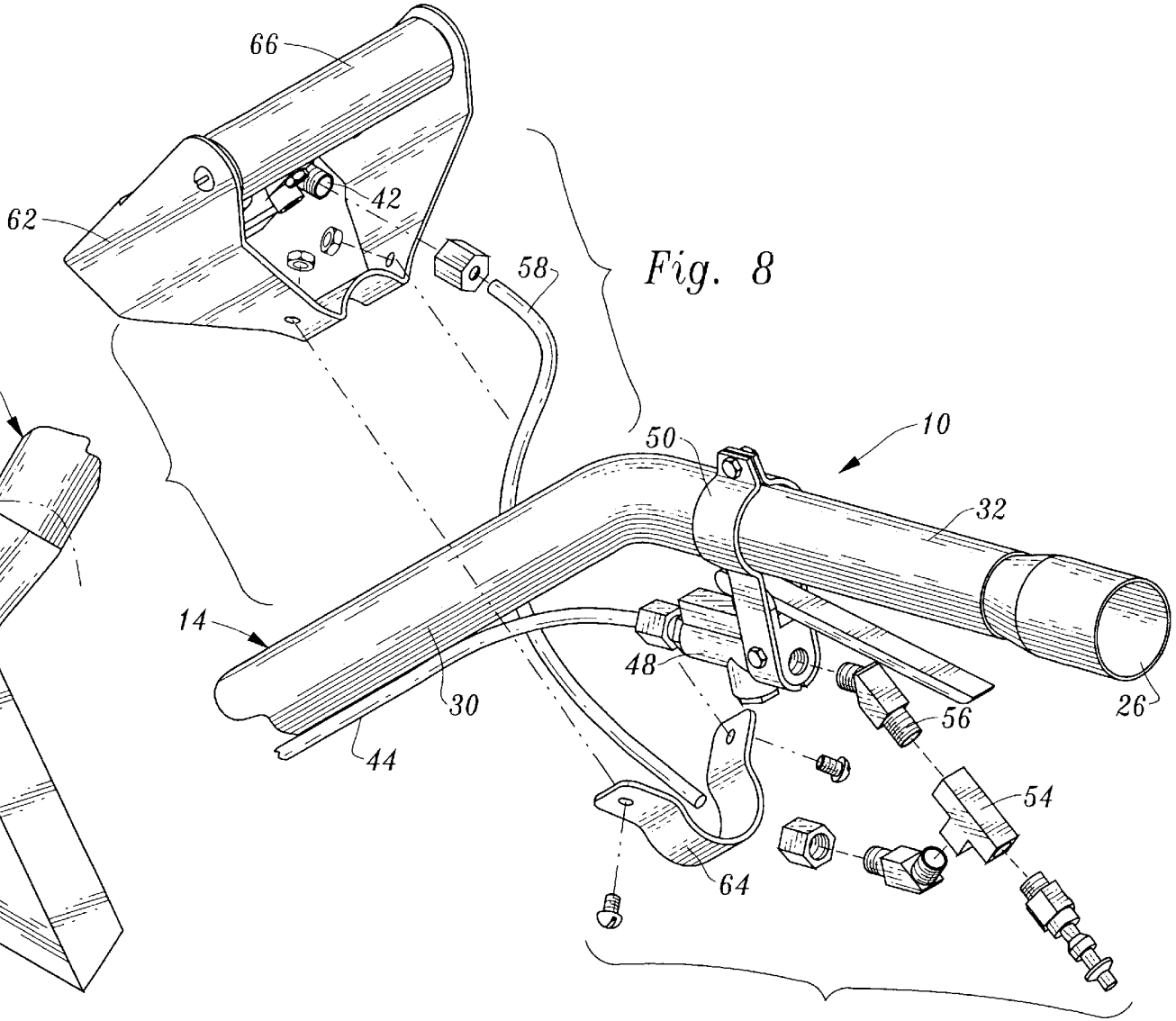
FIG. 8 is an exploded, perspective view illustrating selected structure relating to cleaning fluid delivery to the two valves employed in the apparatus.

When, however, the operator manually grasps slidable handle or trigger portion 72 and moves it upwardly, as shown in FIG. 6B, the link arms will be caused to pivot about pivot members 78 affixed to the housing, resulting in engagement of the actuator 76, depression thereof and opening of control valve 42. When manual upwardly directed pressure is released from handle or trigger portion 72, the structural elements will return to the positions shown in FIG. 5.

The fluid flow control valve 42 is disposed within the interior of the housing 62 and is secured to the housing by threaded fasteners.

It will be seen from the above that the operator employing the apparatus can selectively open or close the fluid flow control valves at will. The nozzles spray the water or other liquid cleaner in front of or behind the vacuum head as desired. This greatly improves the efficiency of the cleaning operation. The efficiency of the wand is essentially doubled since each hand of the operator can control the water spray whenever the operator wishes.

This selective ability of the operator has numerous applications. For example, when an area rug is being cleaned the operator can hold down the rug with his or her foot while cleaning the carpet in a forward motion. By cleaning in the forward motion and holding the rug in place with his foot movement of the carpet is prevented, eliminating the need for a second operator. Still another operating advantage is that the apparatus can be used to start cleaning at the closest location of a building. Use of conventional drag and scrub wands requires that cleaning normally start at the furthest location of a building because the cleaning is only on the backward stroke. With the present invention an operator can start at the front door of a building and work to the farthest point. For a carpet cleaner who likes to apply a neutralizing rinse to the carpet, this is a real time saver, because it saves the operator from having to drag hoses back to the far end of the building. By starting carpet cleaning at the front of the building and cleaning forward to the end of the building, the operator can start applying the neutralizing rinse at the far end of the building, working back to the front, with the advantage of not having to re-stretch hoses a second time.

Figure 9:
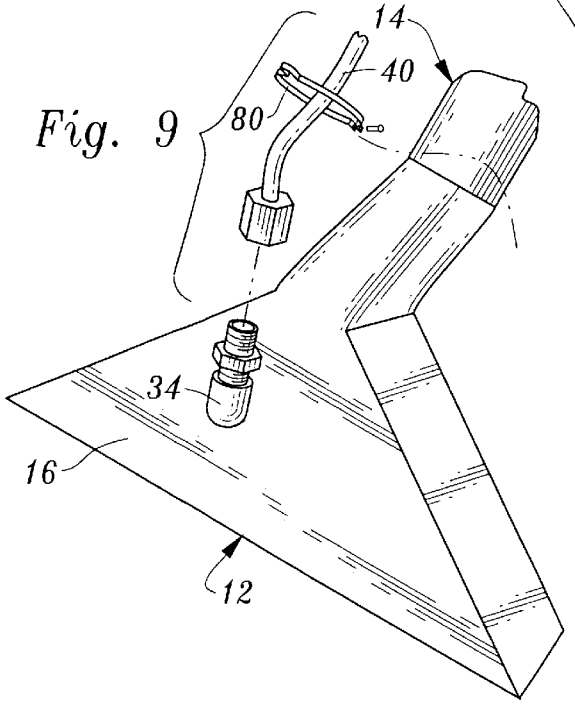
FIG. 9 is a perspective view showing the vacuum head and an alternative approach for attaching a front spray nozzle thereto.

The teachings of this invention are applicable for incorporation in cleaners during their manufacture but also may be incorporated in retrofits to existing cleaners. FIG. 9 shows use of a ring clamp 80, rather than a permanent bracket, to install conduit 40 and spray nozzle 34 at the front of a vacuum head to retrofit the wand.

Another advantage of the carpet cleaning apparatus is that it can clean the edges of a carpet against the wall without having to lift the wand up to spray the edge of the carpet. This is a great advantage especially if the carpet has dark filtration stains that appear on the edges of the carpet because the solution jet is closer to the wall.

This method is faster than the old system because you don't have to break the vacuum seal by lifting up the wand to spray the cleaning solution against the edge of the carpet. The old system requires you to lift the wand up to spray your cleaning solution onto the carpet and there is always an unavoidable overspray that occurs on the wall. With the carpet cleaning apparatus of this invention the overspray is avoided because you don't have to raise the wand to inject the cleaning solution into the carpet.

The invention claimed is:

1. Carpet cleaning apparatus comprising, in combination:

a cleaning wand including a vacuum head having a vacuum head front and a vacuum head rear for applying a vacuum to a carpet and defining a vacuum head interior and a vacuum head inlet communicating within said vacuum head interior and an elongated member connected to said vacuum head and leading to a vacuum source, said elongated member defining a passageway in communication with said vacuum head interior for applying a vacuum to said vacuum head interior and transporting material removed from a carpet by said vacuum head;

a first manually graspable handle connected to said elongated member at a first location on said elongated member;

a second manually graspable handle connected to said elongated member at a second location on said elongated member;

a front spray nozzle located adjacent to the vacuum head at the vacuum head front and in front of the vacuum head inlet;

a rear spray nozzle located adjacent to the vacuum head at the vacuum head rear and to the rear of the vacuum head inlet; and valve means operatively associated with said first and second manually graspable handles for selectively controlling the flow of cleaner fluid to said front and rear spray nozzles from a source of cleaner fluid, said valve means including a first fluid flow control valve operatively associated with said first manually graspable handle for receiving cleaner fluid from the source of cleaner fluid and a second fluid flow control valve operatively associated with said second manually graspable handle for receiving cleaner fluid from the source of cleaner fluid, said first fluid flow control valve controlling the flow of cleaner fluid to said front spray nozzle responsive to manipulation of said first manually graspable handle and said second fluid flow control valve controlling the flow of cleaner fluid to said rear spray nozzle responsive to manipulation of said second manually graspable handle.

2. The carpet cleaning apparatus according to claim 1 additionally comprising cleaner fluid supply conduit means extending to said first and second fluid flow control valves for delivering cleaner fluid from the source of cleaner fluid to each of said first and second fluid flow control valves.

3. The carpet cleaning apparatus according to claim 2 wherein said cleaner fluid supply conduit means comprises a primary conduit and first and second branch conduits in fluid flow communication with said primary conduit, said first branch conduit leading to said first fluid flow control valve and said second branch conduit leading to said second fluid flow control valve, said carpet cleaning apparatus additionally comprising a conduit connector interconnecting said primary conduit and said first and second branch conduits.

4. The carpet cleaning apparatus according to claim 1 wherein one of said first and second manually graspable handles includes a fixed handle portion fixed against movement relative to said elongated member and a slidable handle portion slidably moveable relative to said fixed handle portion and relative to said elongated member.

5. The carpet cleaning apparatus according to claim 4 additionally comprising a housing affixed to said elongated member, said housing defining an opening and a recess communicating with said opening, said fixed handle portion extending across said opening and fixedly attached to said housing and said slidable handle portion mounted for slidable movement in said recess and selectively moveable toward or away from said fixed handle portion.

6. The carpet cleaning apparatus according to claim 5 additionally comprising mechanical linkage interconnecting said slidable handle portion to one of said fluid flow control valves and responsive to sliding movement to said slidable handle portion to selectively open or close the fluid flow control valve to which the slidable handle portion is interconnected by said linkage.

7. The carpet cleaning apparatus according to claim 4 wherein said fixed handle portion and said slidable handle portion are closely adjacent to one another for joint manual grasping of said fixed handle portion and such slidable handle portion.

8. The carpet cleaning apparatus according to claim 1 wherein said elongated member includes a primary elongated member segment and a secondary elongated member segment, said primary elongated member segment directly attached to said vacuum head and being longer than said secondary elongated member segment, said primary elongated member segment and said secondary elongated member segment being angularly disposed, one of said first and second manually graspable handles being attached to said primary elongated member segment and the other of said first and second manually graspable handles being attached to said secondary elongated member segment.

9. The carpet cleaning apparatus according to claim 1 wherein one of said first and second manually graspable handles is disposed above said elongated member and wherein the other of said first and second manually graspable handles is disposed below said elongated member.

10. Carpet cleaning apparatus comprising, in combination:

a cleaning wand including a vacuum head having a vacuum head front and a vacuum head rear for applying a vacuum to a carpet and defining a vacuum head interior and a vacuum head inlet communicating within said vacuum head interior and an elongated member connected to said vacuum head and leading to a vacuum source, said elongated member defining a passageway in communication with said vacuum head interior for applying a vacuum to said vacuum head interior and transporting material removed from a carpet by said vacuum head;

a first manually graspable handle connected to said elongated member at a first location on said elongated member;

a second manually graspable handle connected to said elongated member at a second location on said elongated member;

a front spray nozzle located adjacent to the vacuum head at the vacuum head front and in front of the vacuum head inlet;

a rear spray nozzle located adjacent to the vacuum head at the vacuum head rear and to the rear of the vacuum head inlet;

valve means operatively associated with said first and second manually graspable handles for selectively controlling the flow of cleaner fluid to said front and rear spray nozzles from a source of cleaner fluid, one of said first and second manually graspable handles including a fixed handle portion fixed against movement relative to said elongated member and a slidable handle portion slidably moveable relative to said fixed handle portion and relative to said elongated member; and a housing affixed to said elongated member, said housing defining an opening and a recess communicating with said opening, said fixed handle portion extending across said opening and fixedly attached to said housing and said slidable handle portion mounted for slidable movement in said recess and selectively moveable toward or away from said fixed handle portion.

11. The carpet cleaning apparatus according to claim 10 wherein said valve means includes two fluid flow control valves, one of said fluid flow control valves controlling flow of liquid cleaner to said front spray nozzle head the other of said fluid flow control valves controlling flow of liquid cleaner to said rear spray nozzle, said carpet cleaner apparatus additionally comprising mechanical linkage interconnecting said slidable handle portion to one of said fluid flow control valves and responsive to sliding movement to said slidable handle portion to selectively open or close the fluid flow control valve to which the slidable handle portion is interconnected by said linkage.

* * * * *